US006569374B1

(12) United States Patent
Poulakis

(10) Patent No.: US 6,569,374 B1
(45) Date of Patent: May 27, 2003

(54) METHOD FOR PRODUCING AN ADHESIVE CLOSING COMPONENT

(75) Inventor: Konstantinos Poulakis, Pulsnitz (DE)

(73) Assignee: Gottlieb Binder GmbH & Co., Holzgerlingen (DE)

( * ) Notice: Subject to any disclaimer, the term of this patent is extended or adjusted under 35 U.S.C. 154(b) by 0 days.

(21) Appl. No.: 09/980,118

(22) PCT Filed: Oct. 24, 2000

(86) PCT No.: PCT/EP00/10452

§ 371 (c)(1),
(2), (4) Date: Nov. 30, 2001

(87) PCT Pub. No.: WO01/32044

PCT Pub. Date: May 10, 2001

(30) Foreign Application Priority Data

Oct. 30, 1999 (DE) ..... 199 52 417

(51) Int. Cl.[7] ..... B29C 47/08

(52) U.S. Cl. ..... 264/447; 264/448; 264/167; 264/211.13

(58) Field of Search ..... 264/447, 448, 264/167, 211.13; 24/452, 448; 428/100; 427/508, 387

(56) References Cited

U.S. PATENT DOCUMENTS 4,696,854 A * 9/1987 Ethier ..... 427/501
4,871,611 A * 10/1989 LeBel ..... 427/394
5,605,729 A * 2/1997 Mody et al. ..... 156/66
5,691,027 A * 11/1997 Eckhardt et al. ..... 24/306
5,902,427 A * 5/1999 Zinke et al. ..... 156/290
6,287,665 B1 * 9/2001 Hammer ..... 24/452
6,303,062 B1 * 10/2001 Aamodt et al. ..... 264/167

FOREIGN PATENT DOCUMENTS

| | | |
|---|---|---|
| DE | 19828856 | 10/1999 |
| DE | 19906008 | 8/2000 |
| EP | 0754415 | 1/1997 |
| EP | 0894448 | 2/1999 |
| EP | 1038461 | 9/2000 |
| WO | 9857565 | 12/1998 |

* cited by examiner

*Primary Examiner*—Mark Eashoo
(74) *Attorney, Agent, or Firm*—Roylance, Abrams, Berdo & Goodman, L.L.P.

(57) ABSTRACT

A method produces an adhesive closing component having a carrier with a plurality of interlocking means on one of its two sides. An adhesive is applied to the opposite side. A silicone-containing separation layer is at least partially applied on the side of the carrier provided with the interlocking means. The interlocking means are formed from stems provided with enlargements on the ends. The silicone-containing separation layer is applied in the cavities of the enlargements in a reinforcing manner. The enlargements form individual interlocking heads. The stems are essentially kept free from the silicone-containing separation layer. An adhesive closing component with adhesive means is improved such that the component can be produced cost-effectively and efficiently. Handling is simplified, and pulling-off characteristics are improved.

16 Claims, 3 Drawing Sheets

METHOD FOR PRODUCING AN ADHESIVE CLOSING COMPONENT

Figure 1:
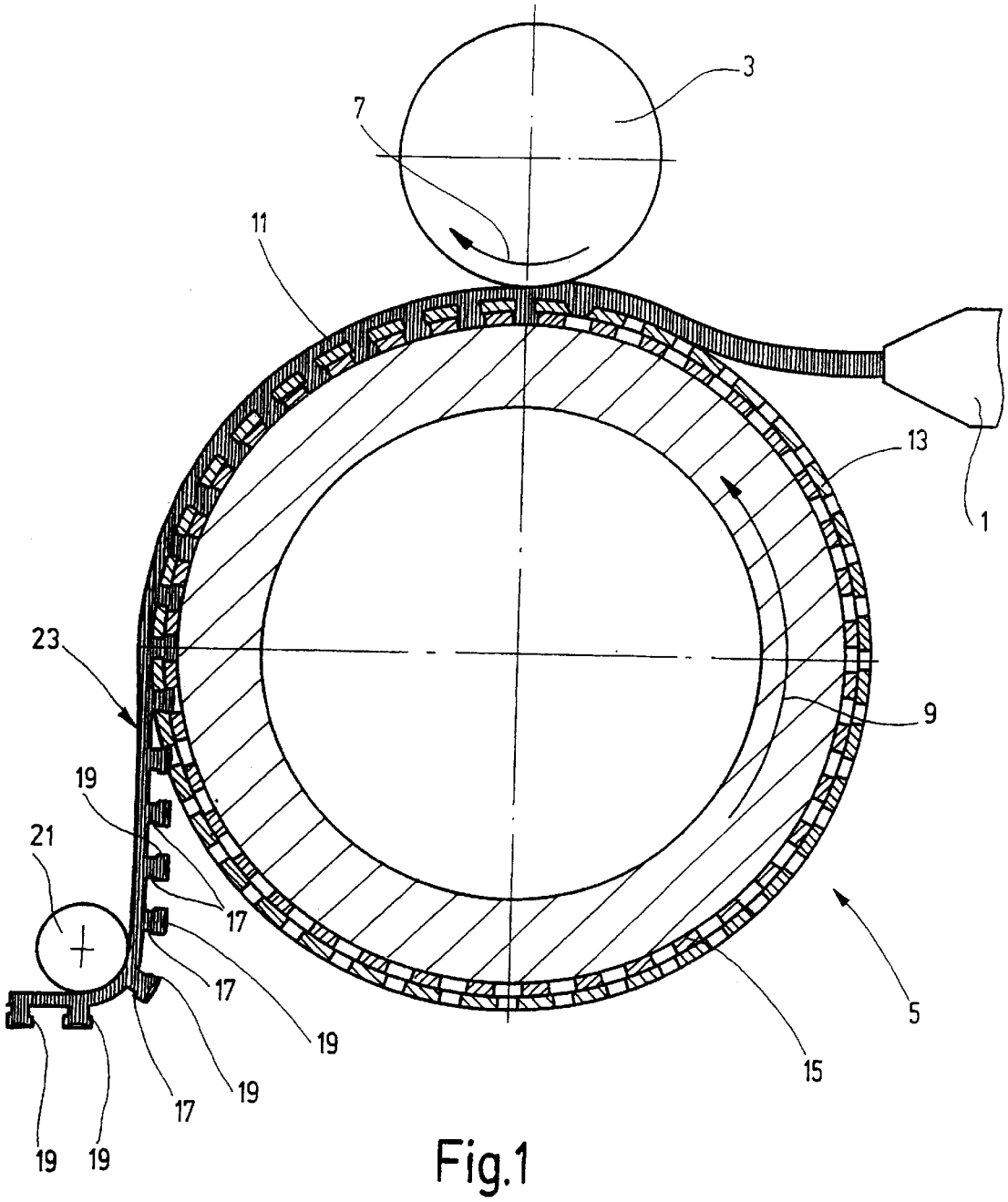

The invention relates to a method for producing an adhesive closing component having a plurality of interlocking means designed having a carrier, the interlocking means configured on one of the two sides of the carrier, whereby an adhesive medium is applied to the opposite side and whereby on the side of the carrier carrying the interlocking means is at least partially applied a separation or barrier layer containing silicon.

Such manufactured adhesive closing components can be wound in the form of strip or surface material forming rolled bundles, whereby the relevant adhesive medium is understood to be generally in the form of a molten rubber base adhesive with a covering paper, in order to avoid having the adhesive medium become tightly adhered to the interlocking means arranged there under. The adhesive medium serves subsequently to secure the adhesive closing component in some manner dependent upon its intended use to a flooring or to a diaper material, insofar as the adhesive closing component serves for the fastening of a carpet material and/or as closing component for a baby diaper or the like. Since adhesive closing components are used in large-scale production technology, and for their subsequent processing for example in the area of baby diapers, the components are connected through automatic processing machines with the diaper material, whereby they are subjected to very high production velocities, wherein the covering material of the adhesive medium frequently presents a problem, since this covering material must be pulled off, carried away and disposed of before the actual processing of the adhesive closing component. If the thin covering paper is torn away and if the adhesive closing component together with the remaining covering paper is fed to the processing machine, the entire production process is disrupted, which frequently can lead to high breakdown costs.

From DE-U-94 21 906, seen as present state of the art, a loop closing material assembly with no cover as well as a method for manufacture of the same with one or more multiple-layer loop closing material layers for the loop component of an interlocking and loop closing arrangement is already known, whereby the loop closing material in the following sequence is made up of:

1. a loop layer on its main surface, whereby the loop layer includes a plurality of flexible loops, which, with the complementary interlocking part of the interlocking and loop closing, are suitable to function in detachable engagement and whereby said loops are anchored on a carrier, and
2. an automatic adhesive layer on its second primary surface.

In the case of this known solution the loop closing material is arranged in the assembly in such a manner that the adhesive layer of a section of the loop closing material and lying over the loop closing material is found in direct contact with the loop layer of a section of the loop closing material lying thereunder, whereby the loops are provided in such a manner that with the removal of the section of the loop closing material from the assembly lying over it, the loops being carried along by the adhesive material are aligned upright and thus offer the section lying thereunder a capacity for engagement. To ensure the resulting effect, a separation or barrier control means is inserted in the material of the loop layer, whereby with the known solution even reactive silicon can be used. Consequently, all of the loop material must be provided with effective means for separation control, in order to maintain the described effect. This entails use of considerable quantities of silicon-containing separation or barrier control material, which influences the known method then by involving costly and expensive production. Despite the resulting complete siliconizing, it can occur therefore that the relevant loop of the loop material is in contact with only a small contact surface, with the adhesive layer of the carrier lying over it and with the interlocking means then in the form of loop material. Consequently the adhering forces are then smaller than those in the environment of the closing material, of which the loops are more or less completely in contact with the adhesive medium. Because of this very different characteristic then a different pulling off behavior with different pulling off forces is to be observed, which involves greater difficulty in the handling of the rolled-up closing material. Furthermore repeated winding up and out of the loop-closing assembly with corresponding adhering of the material layers is possible only with great difficulty.

Starting from this state of the art the object of the invention is to further improve an adhesive closing component using adhering means in such a manner that this closing arrangement can be produced at low cost and efficiently with simplified handling and pulling-off characteristics. Such an object is obtained by a method having the features found in claim 1.

Owing to the fact that according to the disclosure part of claim 1 the interlocking means are formed of stems having enlargements at their ends and that the silicon-containing separation or barrier layer is applied in the cavities in the enlargements forming the individual interlocking heads in a reinforcing manner and the stems are held essentially free by the silicon-containing separation or barrier layer, with a slight material addition to the silicon-containing separation or barrier layer material and/or to the separation control means, the effective desired winding up and out characteristic can be attained for the strip-like adhesive closing component. Since the silicon-containing separation or barrier layer is distributed in essentially equal portions in the relevant frontal cavity of each interlocking head, a uniform opening and unwinding behavior is therefore attained, so that there is a uniform force distribution of the adhesive forces between adhesive layer and interlocking material. Therefore it is novel and remarkable for an expert in this art that the disclosed method with the indicated measures not only attains a uniform pulling-off behavior, but that with the manufacturing method according to the invention an adhesive closing component is obtained with which it is possible to undertake multiple winding up and winding out processes, whereby the repeated winding up and out processes lead in turn to a corresponding but not permanent adherence of interlocking means with the adhesive medium lying over it. Besides, the quantity of separation or barrier silicon material to be used is optimized in such a manner that in any case either the adhering-or the peeling off-forces are small in such a manner that the winding of the adhesive closing component off of the bundled roll for further processing is not compromised or negatively influenced even when robotic mechanisms are used. Besides, the covering material in the form of a covering paper or the like covering the adhesive medium also can be completely abandoned, which likewise makes the subsequent processing of the adhesive closing component simpler and more reliable.

In the case of one preferred embodiment of the method according to the invention silicon acrylate is used as separation or barrier layer, and a hardening method by means of radiation is provided for the hardening. It has been shown that particularly solvent-free silicon acrylate which is 100% radiation-hardenable leads to very good results and the adhesive medium adheres as little as possible to the silicon acrylate, insofar as it is hardened.

In one particularly preferred embodiment of the method of the invention the interlocking means consist of stems having enlargements on the ends, for the manufacture of which a plastic material is fed into a gap between a pressure tool and a molding tool and these tools are then driven so that the carrier is formed in the gap and is conveyed in the direction of conveyance, whereupon on the molding tool a screen having hollow spaces passing all the way through is used as molding-shaping element, by which the interlocking means are formed in such a manner that the plastic material hardens at least partially in the hollow spaces of the screen. The resulting method of manufacture for the carrier is known from DE 198 28 856 C 1. As a result, in large-scale measure very rapid manufacture of the starting material in the form of strip or surface adhesive closing components can be manufactured to be coated thereafter.

The silicon-containing separation or barrier coating is preferably in gaseous or vaporous state, or fluid, pulp, mash or pasty state, or ionized state as a result of electrolytic or chemical separation, or solid, particularly granular or powdered state and in one of these states is applied to the plastic material. Thus it has been proven as a particularly favorable manufacturing technique for the radiation hardening of the separation or barrier layer to use at least one UV-radiation source. Furthermore this provision has produced particularly good cavity-filling behaviors, insofar as the adhesive medium used in this case is an adhesive on a rubber base.

In one particularly preferred embodiment of the method according to the invention in the cavities of the enlargements forming the interlocking heads the silicon separation or barrier layer is applied in a reinforcing manner and the stems are held free essentially by the silicon separation or barrier layer. Since the interlocking heads which are thus coated are provided with a sort of a sliding layer, the corresponding loops or engagement parts of another adhesive closing component, which together with the first adhesive closing component forms the adhesive closing, slide on the reverse sides of the corners and edges of the interlocking heads, which leads to improved interlocking behavior with the result that higher detachment forces are required to detach the adhesive closing involving separation of the adhesive closing components. The effect is then obtained that the loop material no longer comes to engage directly on the interlocking heads, but rather slides away from them because of the separation coating and engages in the intermediate spaces between the interlocking heads and there and then causes the interlocking to take place.

In addition, with the method of the invention it is preferably provided that a thermoplastic plastic is used as plastic material. The method of the invention furthermore provides that the adhesive closing component is rolled up into transportable bundles, so that the adhesive medium is in direct contact with the interlocking means lying under it.

Thus it is shown that in the direction of conveyance of the adhesive closing component the velocities at which the coating process can be carried out are between 10 and 100 m/min. This remarkably increases the speed of production of the adhesive closing component of the invention, whereby these manufacturing velocities could not be attained insofar as the adhesive medium would be provided in traditional manner with a covering strip or covering paper.

Figure 2:
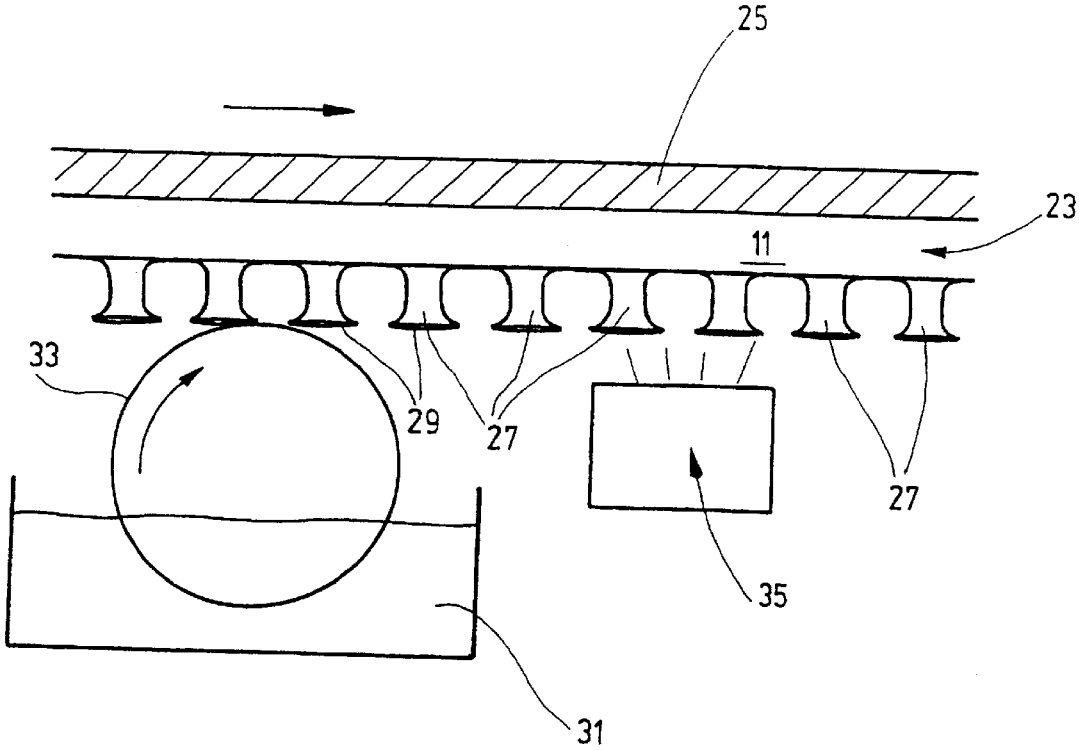
Figure 3:
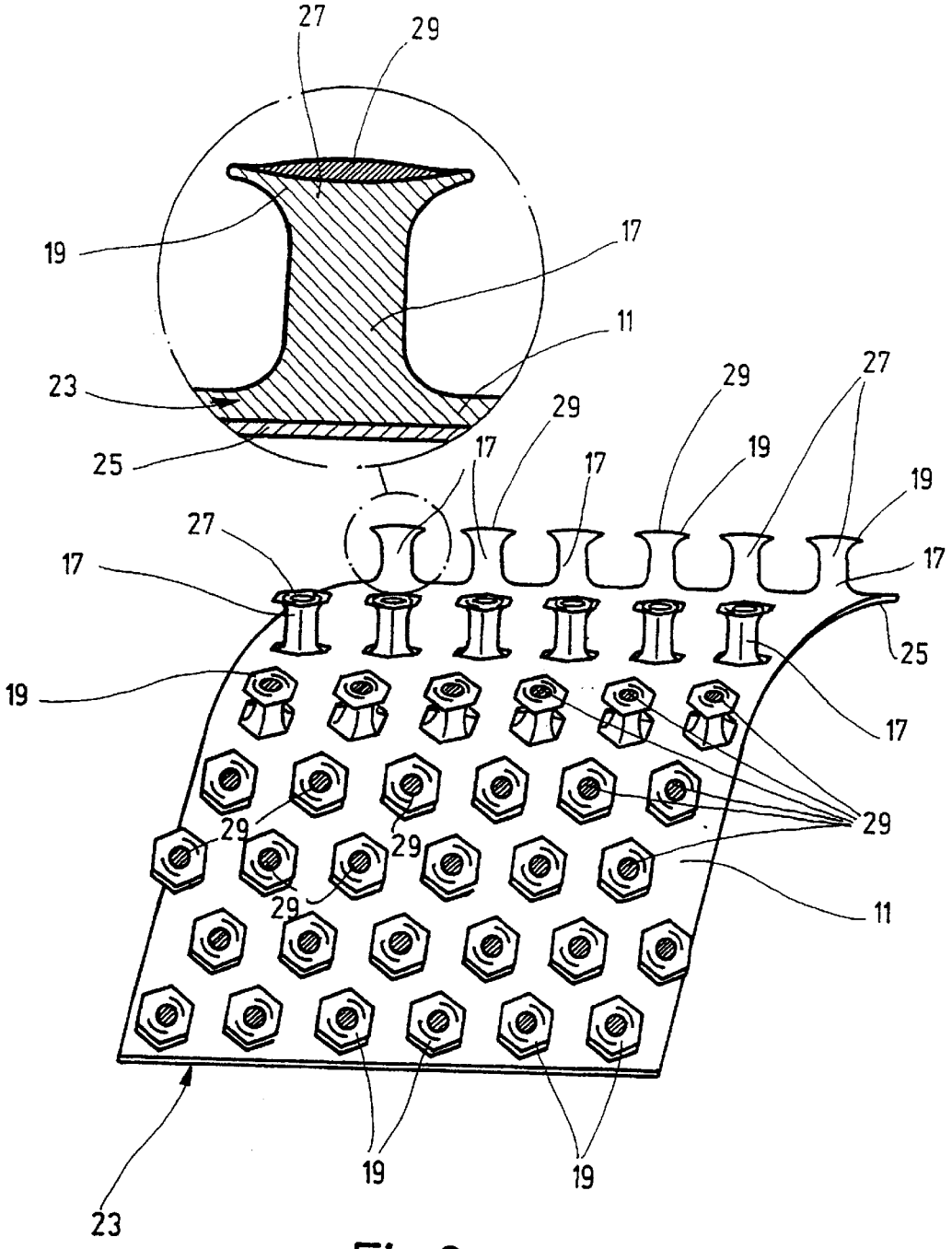

Hereinafter the invention is to be explained in greater detail relative to one embodiment according to the drawing. In this drawing a representation is shown in principal and not in scale, showing as follows:

FIG. 1 a partial cross section of a side view of a device for the manufacture of the adhesive closing component without adhesive medium coating and without application of the silicon-containing covering layer;

FIG. 2 a diagrammatical extremely simplified representation of an application method for the silicon-containing covering layer;

FIG. 3 a representation of a side view of the adhesive closing component with adhesive medium layer and silicon-containing covering layer.

FIG. 1 shows a diagrammatic representation of the components of a device for execution of the method according to the invention with an extruder head 1 embodying a feed device for thermoplastic plastic material found in plastic or fluid state, whereby the plastic is fed in in the form of a strip, of which the width corresponds to that of the adhesive closing component to be produced, which is fed into the gap between a pressure tool and a molding tool. A platen roll 3 is provided as the pressure tool. The molding tool is in the form of a grooved roll indicated in its entirety as 5. The two rolls are driven in the directions of rotation shown in FIG. 1 with curved arrows 7 and 9, so that between them is formed a conveying gap, through which the plastic strip is conveyed in direction of conveyance, and simultaneously while it is in the gap the plastic strip is formed into the carrier 11 of the adhesive closing component, and carrier 11 on the side engaging on grooved roll 5 is subject to the molding-shaping elements which are inherent in grooved roll 5 which provide the required molding and shaping for the formation of interlocking means.

For this purpose grooved roll 5 has two molding-shaping elements around its periphery, each in the form of a screen, which include an exterior screen 13 and an interior screen 15, which are aligned one adjacent to the other. The aforementioned screens 13 and 15 are fitted onto one another in such a manner that the hollow spaces formed by the screen openings of exterior screen 13 and interior screen 15 are aligned flush with one another and have a common axis.

The thickness of exterior screen 13 is greater than that of interior screen 15, of which the hollow spaces in turn are larger in cross section than the hollow spaces of exterior screen 13. Because of this configuration the plastic pressed into the hollow spaces in the gap between platen roll 3 and grooved roll 5 is shaped so that projecting stems 17 with enlarged ends 19 are formed on carrier 11. The difference of the cross sectional dimensions of the hollow spaces is selected so that the widening out at ends 19 is only so great that following partial or complete hardening of the plastic material the withdrawal of stems 17 from the hollow spaces can still be executed reliably, when carrier 11 is guided away from grooved roll 5 by means of a withdrawing roll 21. Adhesive closing component 23 thus manufactured is represented partially in side view in FIGS. 2 and 3, in which said adhesive closing component 23 is provided with a layer 25 of adhesive medium coating on its reverse side. The adhesive medium being used is preferably a rubber base adhesive and thus in turn is a traditional product and therefore its type and manner of application to the reverse side of adhesive closing component 23 are not more closely described herein. Enlarged ends 19 on stems 17 form the specific interlocking means 27 which are to be provided with the separation or barrier coating. Enlarged ends 19 in turn can be calendered for subsequent molding-shaping as interlocking heads of interlocking means 27, which is not shown in greater detail.

A silicon-containing separation or barrier layer 29 which is subsequently hardened is at least partially applied on the side of carrier 11 having interlocking means 27. Particularly silicon acrylates are used as separation or barrier layer 29, whereby a radiation hardening method can be used for the hardening. The hardening thus depends on the polymerization of the C-C-double bonds of the acrylate groups by means of a chain reaction of radicals. While with the electron radiation hardening, the high radiation energy produces a sufficient quantity of radicals for the spontaneous polymerization process, UV-light has low energy in comparison with electron radiation. Therefore with the UV-hardening the addition of a photoinitiator is quite suitable and even significant, of which the dissociation provides the required high local radical concentration which is required for the polymerization. Production of radicals and immediate chain growth already at room temperature cause a rapid and effective three-dimensional latticelike polymerization of the silicon acrylates with one another.

One basic effect resulting from the radical polymerization is the inhibiting by atmospheric.oxygen. The expanding radical chain is interrupted by contact with oxygen, since the reaction of the monomer radicals with oxygen on account of the considerable excess takes place notably more rapidly than the reaction with free monomers. The prevention of chain growth leads to only short-chained, still fluid polymers, whereupon the substrate surface is oily or sticky and therefore is unsuitable for further use. However these results can be avoided when the hardening is carried out under inert gas. By spraying with nitrogen then the concentration of atmospheric oxygen in the hardening zone is lowered into the non-detrimental range.

It is particularly environmentally compatible to use silicon acrylates which have 100% solid body content and therefore can be processed free of solvents. Since no catalyst is required for the hardening, also no polluting can be caused by polluting matter in the substrate. Accordingly, this sort of coated adhesive closing component can be disposed of or recycled without causing any destructive environmental pollution. In addition to the cited electron radiation and UV-hardening method, a thermal hardening of the silicon covering is also possible and is quite conceivable. The aforementioned coating with silicon acrylate can be carried out working from the gaseous or vaporous state, for example by means of vapor deposition. Another coating possibility is obtained from the fluid, pulp, pasty, or mash state by coating, dispersion- or melt-coating as well as by extrusion, casting or dipping. With the preferred embodiment according to FIG. 2, the silicon coating material is found in a bath 31 and from the bath is applied by means of an applicator roll 33 to the enlarged ends 19 of interlocking means 27. The direction of rotation of application roll 33 is shown in FIG. 2 with an arrow to be the same as the continuing direction of conveyance for carrier 11. To the application bath 31 is then attached the UV-hardening device indicated in its entirety as 35. Other coating application possibilities reside in the form of electrolytic or chemical deposition processes or coating methods using products in granular or powdered state.

Insofar as producing the enlarged head ends 19 of interlocking means 27 requires all available manufacturing technology regarding cavitation, this cavity filling can be augmented using the silicon-containing separation or barrier layer medium 29. However it is also conceivable that according to the method of the application the points on the top of carrier 11 held free from interlocking means 27 are silicon-coated, which is not shown. The difference however is that the area which in wound-up state of adhesive closing component 23 is arranged lying opposite and adjacent to the adhesive medium 25 has the silicon covering, in order in this manner to prevent an adhering of the adhesive material to the strip material lying thereunder.

In practical tests it has been shown that the peel resistance measured in N/cm of a traditional adhesive medium 25 on adhesive elements with silicon is 0.65 and without silicon is 4.8. In other words, it is possible to wind up siliconized adhesive elements with adhesive medium 25 arranged on the reverse side of the strip in roll bundles, not shown, without any problem, even when the covering paper for adhesive medium 25 has been removed.

The following series of tests shows the particular suitability of such siliconized adhesive closing components 23.

Series of Tests 1:

Reviewing the tests one day following the latticelike polymerization of the silicon acrylates with a processing velocity of 10 m/min., adhesive closing component 23 using a rubber base adhesive medium 25 was pressed manually on siliconized adhesive closing 23 and not charged further.

Slice-1: Adhesive closing component 23 with adhesive medium 25 drawn off of siliconized adhesive closing component 23 and adhered to sheet steel.

Slice-2 : Direct slice test of siliconized adhesive closing component 23. In the zero-point test of adhesive medium 25 are found 2.9 to 3.2 atom-percentages silicon.

| Review/Day | Temp/° C. | |
|---|---|---|
| 1 | 70; 70 | |
| 5 | 70; 70 | |
| 12 | 70; 70 | |
| Slice-1/N $cm^{-1}$ | Slice-2/N $cm^{-1}$ | Si/Atom-% |
| 11.5; 13.5 | </−1.2 | 7.0; 7.3 |
| 11; 12 | </−1.3 | 6.6; 7 |
| 11; 11.5 | </−0.5 | 4.6; 7.6 |

Series of tests 2

Reviewing the tests five days following the latticelike polymerization of the silicon acrylates with a processing velocity of 100 m/min., the adhesive closing component 23 with adhesive medium 25 was pressed manually on the siliconized adhesive closing component 23 and the tests were passed between two sheets having dimensions of 300 mm×300 mm, with approximately 5.5 kg pressure.

| Review/Days | Temp/° C. | |
|---|---|---|
| 1 | 70; 72 | |
| 6 | 60; 65 | |
| Slice-1/N $cm^{-1}$ | Slice-2/N $cm^{-1}$ | SI/Atom-% |
| 10.5; 11 | </−0.5 | 11.4; 11.4 |
| 9; 8.5 | a | 14.2; 12.8 |

wherein:
a = not measurable, since the separation force is too low.

Consequently for the coating processes even high velocities of up to between 10 and 100 m/min can be undertaken with good results. Insofar as the siliconized adhesive elements of adhesive closing component 23 are still not completely hardened, a small silicon transfer to the adhesive is still possible, which however does not negatively influence the adhesive property. With the method of the invention, in any case it is possible to roll up the adhesive closing component 23 into transportable bundles, so that adhesive medium 25 is cover-free in direct contact with interlocking means 27 arranged directly under it and that however the resulting adhesive closing component 23 can be rolled out from the roll bundle for further processing without any problem.

In one further modified embodiment of the adhesive closing component according to the invention but which is not shown herein, this component can be made up of a fabric, whereby the interlocking means in turn consist of individual loops which are connected with the fabric. The fabric can be a textile or a plastic hence synthetic material. Furthermore it is possible that the individual loops which are of one integral piece with the fabric are connected or are woven into this fabric as supplement thereto. The resulting adhesive closing component with loop elements is then likewise subjected to the method of the invention in which it is coated with a siliconized material, whereby the resulting coating material surrounds the loops even along their interiors and also the carrier material in the form of the textile or synthetic fabric is thus coated by the silicon material.

Preferably, cationic radiation hardening is used with such an embodiment, in which cycloaliphatic compounds are particularly suitable, which are easily polymerized with ring opening, including for instance cycloaliphatic epoxides. Among other compounds onium salts serve as photoinitiators, which under UV-radiation form free Lewis or Broensted acids. The advantage with cationic radiation hardening is that even following passage through the UV radiation source subsequent further hardening of the silicon-containing separation or barrier layer occurs on the adhesive closing component with its loop elements.

What is claimed is:

1. A method for producing an adhesive closing component having a plurality of interlocking means configured on a first side of a carrier, comprising the steps of:

forming the adhesive closing component with the interlocking means being stems having individual head enlargements at ends thereof and with the enlargements having cavities;

applying an adhesive medium layer on an opposite, second side of the carrier; and applying a silicon-containing separation layer in the cavities of the enlargements in a reinforcing manner, while holding the stems essentially free of the silicon-containing separation layer.

2. A method according to claim 1 wherein silicon acrylates are used for the separation layer; and the separation layer is hardened by radiation.

3. A method according to claim 1 wherein the adhesive closing component is formed by feeding plastic material into a gap between a pressure tool and a molding tool, while driving the tools to form and convey the carrier in the gap in a conveyance direction;

the interlocking means are molded in a screen on the molding tool, the screen having hollow spaces passing therethrough in which the interlocking means are formed; and the plastic material is at least partially hardened in the hollow spaces of the screen.

4. A method according to claim 3 wherein the separation layer is applied by coating in the conveyance direction at a rate of between 10 and 100 meters per minute.

5. A method according to claim 1 wherein the silicon-containing separation layer is applied in one of the group consisting of a gaseous state and vaporous state.

6. A method according to claim 1 wherein the silicon-containing separation layer is applied in one of the group consisting of a fluid state, pulp state, mash state and pasty state.

7. A method according to claim 1 wherein the silicon-containing separation layer is applied in an ionized state as a result of one of the group consisting of electrolyte separation and chemical separation.

8. method according to claim 1 wherein the silicon-containing separation layer is applied on a solid state.

9. A method according to claim 1 wherein the silicon-containing separation layer is applied in one of the group consisting of a granular state and a powdered state.

10. A method according to claim 1 wherein the separation layer is hardened by radiation using at least one UV radiation source.

11. A method according to claim 10 wherein the separation layer is applied by coating in the conveyance direction at a rate of between 10 and 100 meters per minute.

12. A method according to claim 1 wherein the adhesive medium layer is formed of a rubber base adhesive.

13. A method according to claim 12 wherein the separation layer is applied by coating in the conveyance direction at a rate of between 10 and 100 meters per minute.

14. A method according to claim 1 wherein the adhesive closing component is formed of thermoplastic plastic.

15. A method according to claim 1 wherein the adhesive closing component is rolled into transportable bundles with the adhesive medium layer in direct contact with the interlocking means located directly thereunder.

16. A method according to claim 15 wherein the separation layer is applied by coating in the conveyance direction at a rate of between 10 and 100 meters per minute.

* * * * *